US009644374B2

(12) United States Patent
Ivic

(10) Patent No.: US 9,644,374 B2
(45) Date of Patent: May 9, 2017

(54) PERGOLA COVER

(71) Applicant: Michael Ivic, Gretna, LA (US)

(72) Inventor: Michael Ivic, Gretna, LA (US)

( * ) Notice: Subject to any disclaimer, the term of this patent is extended or adjusted under 35 U.S.C. 154(b) by 142 days.

(21) Appl. No.: 14/578,426

(22) Filed: Dec. 20, 2014

(65) Prior Publication Data

US 2016/0177575 A1 Jun. 23, 2016

(51) Int. Cl.

| | |
|---|---|
| ***E04F 10/08*** | (2006.01) |
| ***E06B 9/386*** | (2006.01) |
| ***E04F 10/10*** | (2006.01) |
| *E04B 7/16* | (2006.01) |

(52) U.S. Cl.

CPC ..... *E04F 10/08* (2013.01); *E04F 10/10* (2013.01); *E06B 9/386* (2013.01); *E04B 7/163* (2013.01)

(58) Field of Classification Search

CPC ..... E04F 10/08; E04F 10/10; E06B 9/386; E04B 7/163

USPC ..... 52/473

See application file for complete search history.

(56) References Cited

U.S. PATENT DOCUMENTS

| | | | | | |
|---|---|---|---|---|---|
| 2,061,548 | A * | 11/1936 | Cameron | E06B 9/382 | 160/173 R |
| 2,231,447 | A * | 2/1941 | Hepworth | E06B 9/386 | 160/173 R |
| 2,239,242 | A | 4/1941 | Miller | | |
| 2,654,425 | A * | 10/1953 | Hayner | E04F 10/10 | 160/172 R |
| 3,084,405 | A | 4/1963 | Kahn et al. | | |
| 3,110,936 | A | 11/1963 | Berard | | |
| 3,123,189 | A | 3/1964 | Wiley | | |
| 3,228,318 | A | 1/1966 | Wheatley | | |
| 3,372,514 | A | 3/1968 | Adams | | |
| 4,038,781 | A | 8/1977 | Graham | | |
| 4,081,173 | A | 3/1978 | McCabe | | |
| 4,304,218 | A * | 12/1981 | Karlsson | F24J 2/0433 | 126/607 |
| 4,527,355 | A | 7/1985 | Numakami | | |
| 5,996,669 | A * | 12/1999 | Miller | E06B 9/15 | 160/133 |
| 6,024,153 | A | 2/2000 | Goldman | | |
| 6,223,804 | B1 * | 5/2001 | Toti | E06B 9/36 | 16/355 |
| 7,770,623 | B2 * | 8/2010 | Wong | E06B 7/082 | 160/133 |

(Continued)

FOREIGN PATENT DOCUMENTS

| | | | | |
|---|---|---|---|---|
| GR | EP 1103670 A1 * | 5/2001 | ..... | E04B 7/163 |

*Primary Examiner* — Brian Glessner
*Assistant Examiner* — Omar Hijaz
(74) *Attorney, Agent, or Firm* — Keaty Law Firm LLC

(57) ABSTRACT

A louver cover for a pergola, arbor and the like has pivotal elongated slat assemblies that move between an open upright position and a closed position covering the pergola. The cover is secured between upright supports and cross beams of the pergola. Each slat assembly has a pivotal shaft mounted for pivotal movement between parallel cross beams. The pivotal shaft carries at least one slat member, which is movable between an upright position when the cover is open and a closed position when the slat assemblies extend in covering relationship over the pergola. In one embodiment, each slat assembly has a slat member with S-shaped profile, and in another embodiment the slat assembly has two mirror image slat members of J-shaped profile.

12 Claims, 4 Drawing Sheets

(56) References Cited

U.S. PATENT DOCUMENTS

| | | | | |
|---|---|---|---|---|
| 7,931,067 | B2 * | 4/2011 | Goodman | E05D 15/26 16/365 |
| 8,225,839 | B2 | 7/2012 | Prine, Sr. | |
| 8,256,486 | B1 | 9/2012 | Thomas | |
| 8,756,873 | B1 * | 6/2014 | Hire | E04F 10/10 49/74.1 |
| 9,157,270 | B2 * | 10/2015 | Hall | E06B 9/15 |
| 2014/0116497 | A1 * | 5/2014 | Sanders | E06B 7/086 136/246 |
| 2016/0060955 | A1 * | 3/2016 | Hsieh | E06B 9/386 160/188 |
| 2016/0168905 | A1 * | 6/2016 | Liao | E06B 7/09 160/115 |

* cited by examiner

PERGOLA COVER

BACKGROUND OF THE INVENTION

This invention relates to covering systems for external structures, and more particularly to a roof cover for pergolas or similar structures.

Many houses have open patios and decks that are used for a variety of outdoor leisure activities, such as entertaining, barbecues and so forth. Free-standing structures, such as pergolas are also a popular feature. Pergolas are conventionally constructed using vertical posts or pillars that usually support cross-beams and a sturdy open lattice cover. Some pergolas have climbing vines that are trained to climb the pergola cover, while other pergolas remain uncovered, that is spaces between the cross beams and latticework remain open.

While the outdoor activities can be conducted in uncovered patios and partially covered pergolas, it is very desirable to have a cover over the open patios, decks, and pergolas that can be closed to protect the users against the sun, rain, and other weather-related conditions. Provision of shade as protection against the sun is particularly important in view of the known links between excessive exposure to sunlight and various skin cancers, especially in those regions of the world affected by depletion of the ozone layer.

Accordingly, it is desirable to provide open structures, such as verandas, pergolas, and other suitable structures, having roofs that may be easily opened or closed, depending upon the prevailing environmental conditions. Previously known arrangements for providing closable coverings include retractable awnings. However, retractable awnings may not be suitable for use with free-standing structures, such as pergolas, arbors, and the like.

It is therefore highly desirable to provide a system employing rotatable louvers or slats that can be manually or mechanically operated particularly for use with outdoor structures, such as pergolas.

SUMMARY OF THE INVENTION

It is, therefore, an object of the present invention to provide a rotatable cover for a free-standing outdoor structure such as pergolas, arbor and the like.

It is another object of the invention is to provide a pergola cover that cost-effective and easy to operate.

These and other objects of the invention are achieved through a provision of a louver cover for a pergola, arbor and the like has pivotal elongated slat assemblies that move between an open upright position and a closed position covering the pergola. The cover is secured between upright supports and cross beams of the pergola. Each slat assembly has a pivotal shaft mounted for pivotal movement between parallel cross beams. The pivotal shaft carries at least one slat member, which is movable between an upright position when the cover is open and a closed position when the slat assemblies extend in covering relationship over the pergola. In one embodiment, each slat assembly has a slat member with S-shaped profile, and in another embodiment the slat assembly has two mirror image slat members of J-shaped profile.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
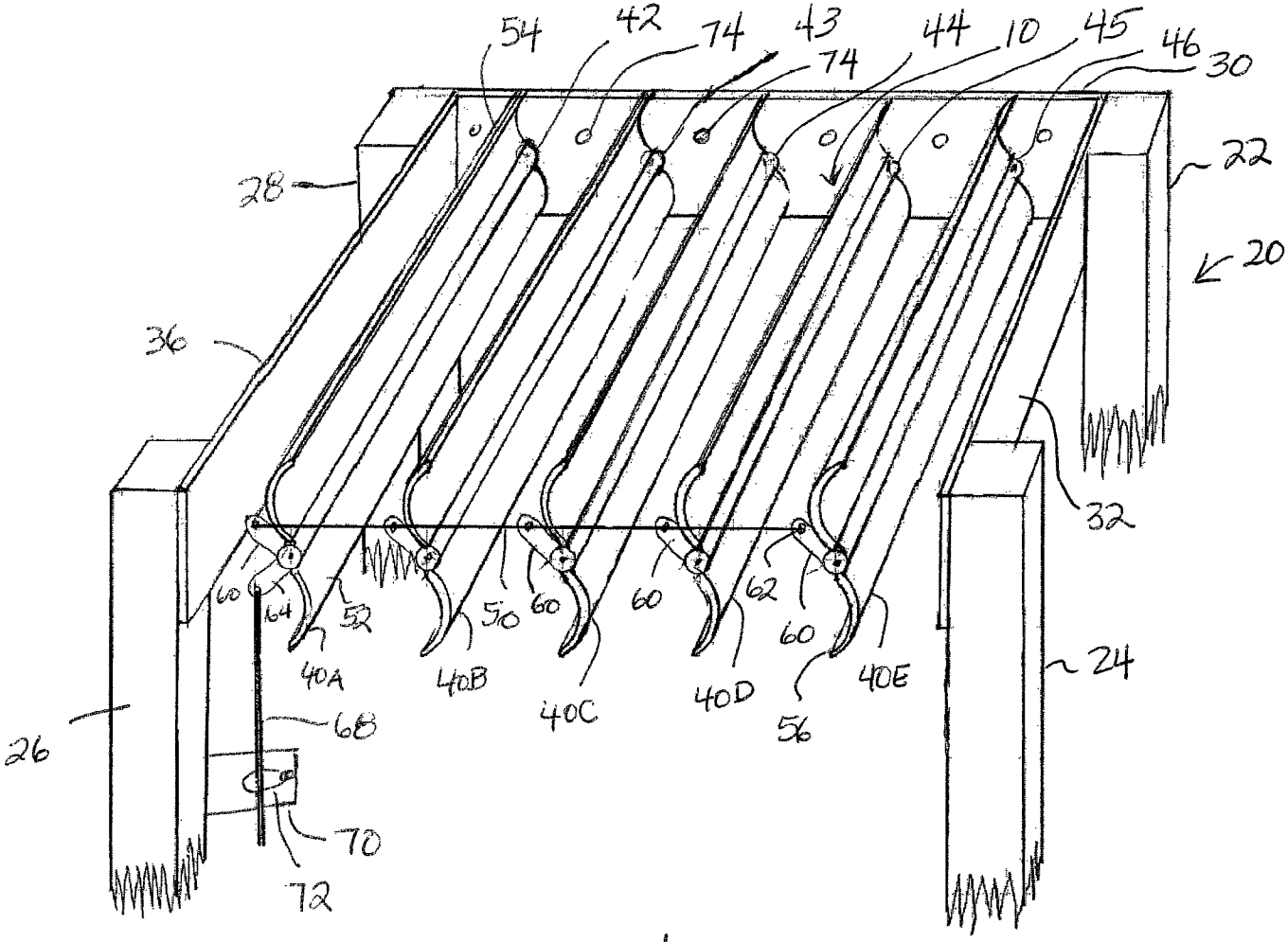
FIG. 1 is a perspective view of the pergola cover system according to the first embodiment of the present invention in an open position.

Turning now to the drawings in more detail, numeral 10 designates the cover system according to the first embodiment of this invention. The system 10 is configured to fit in a covering relationship over a structure 20. The structure 20 comprises a plurality of upright vertical posts or vertical supports 22, 24, 26, and 28 spaced apart to form a rectangular or square frame supports. Cross beams extend between upper ends of the vertical posts 22, 24, 26, and 28. While only three cross beams 30, 32, and 36 are shown in FIG. 1, it will be understood that a forth cross beam is positioned between the upright posts 24 and 26 in a parallel relationship to the cross beam 30. For clarity, the fourth cross beam was omitted from the drawings. The covering system 10 is configured to fit between the cross beams of the structure 20. The covering system 10 comprises a plurality of parallel slat assemblies 40 (40A, 40B, 40C, 40D, 40E, etc.) mounted on pivotal shafts 42, 43, 44, 45, and 46, which are rotationally supported in the cross beam 30 and the fourth cross beam removed from the view of FIG. 1. The slat assemblies 40A, 40B, 40C, 40D, and 40E are connected to a movable rod 50 for synchronized pivoting.

Figure 2:
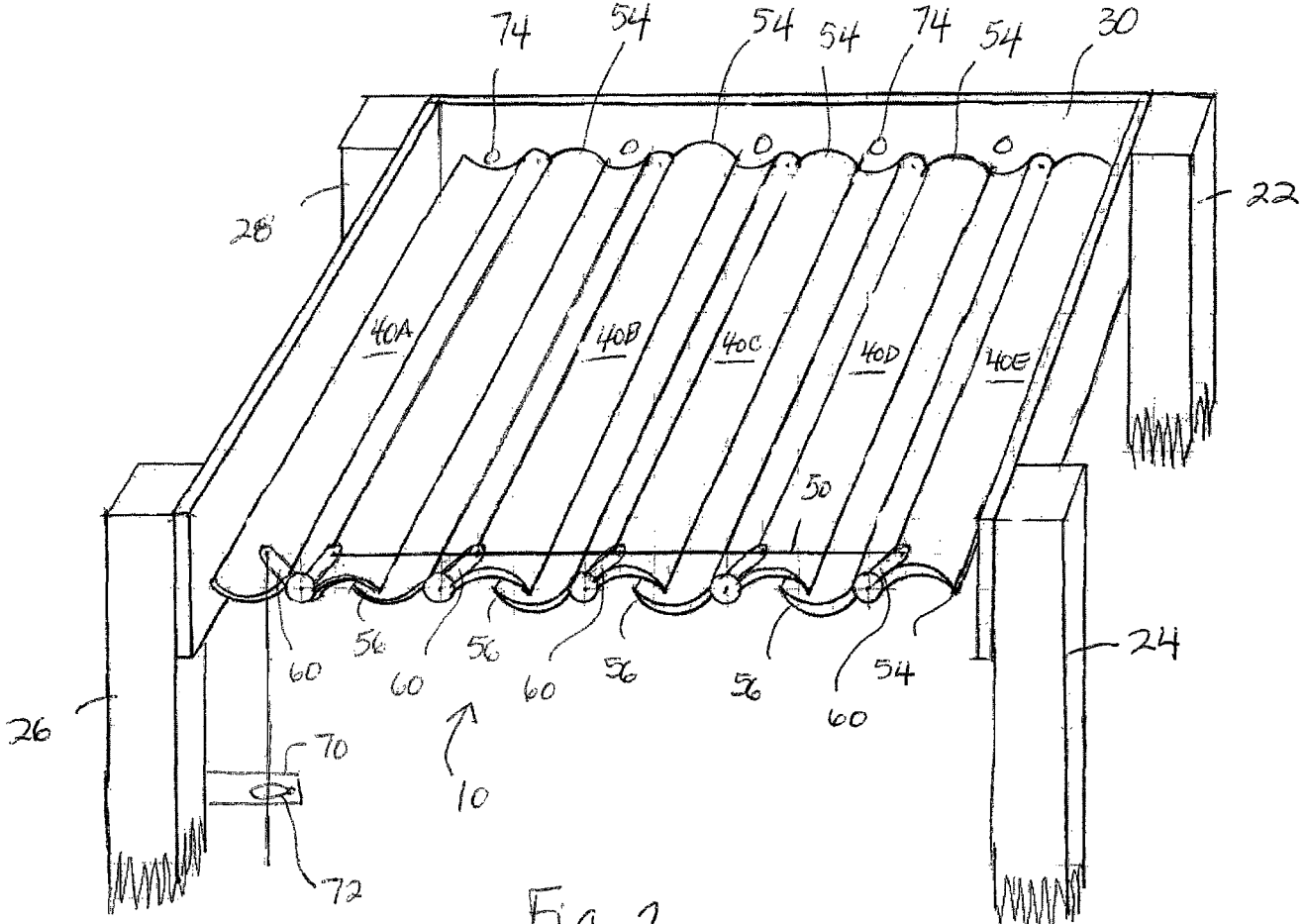
FIG. 2 is a perspective view of the pergola cover system according to the first embodiment of the present invention in a closed position.

Each slat assembly 40 comprises and elongated slat member or louver 52 having a generally S-shaped profile with an upwardly curved longitudinal "upper" edge 54 and a downwardly curved longitudinal "lower" edge 56. In their closed position, the longitudinal edges of the slat members 52 are overlapping, as shown in FIG. 2, so that the "lower" edge of each slat member is received in the upturned "upper" edge of the adjacent slat member. A rod supporting member 60 is fixedly attached to each shaft 42, 43, 44, 45, and 46. An opening 62 is formed in a free end of the rod supporting member 60, and the rod 50 extends therethrough. Each slat assembly 40 comprises and elongated slat member or louver 52 having a generally S-shaped profile with an upwardly curved "upper" edge 54 and a downwardly curved "lower" edge 56. In their closed position, the slat members 52 are overlapping, as shown in FIG. 2, so that the "lower" edge of each slat member is received in the upturned "upper" edge of the adjacent slat member.

A rod supporting member 60 is fixedly attached to each shaft 42, 43, 44, 45, and 46. An opening 62 is formed in a free end of the rod supporting member 60, and the rod 50 extends therethrough. A lever tongue 64 is secured to the shaft 42 extending at an angle to the rod supporting member 60. A lever rod 68 is affixed to the lever tongue 64, extending downwardly therefrom. The lever rod 68 is configured to impart pivotal action on the lever tongue 64 when the lever rod 68 moves up or down.

When the lever rod 68 is in its "down" position, the slat member 52 extends substantially vertically in an upright orientation allowing sun to enter the pergola structure 20. When the lever rod 68 is pushed upwardly, the lever tongue forces the shaft 42 to pivot and impart motion on the rod supporting member 60. In turn, the rod supporting member 60 pushes the pivot rod 50, thereby rotating the slat member 52 in a synchronized manner.

The lever rod 68 can be a manually operated lever or a motorized lever when operationally connected to a power source 70. The power source 70 can be a hydraulic or electrical motor, or a supply of pressurized air. The power source 70 is engaged with the lever rod 68 through a link 72, which transmits the motive force from the power source 70 to the lever rod 68. It will be understood that suitable electrical wiring, if used, can be connected to a standard municipal power source.

The pergola structure 20 is slightly inclined to allow runoff of rain water. The ends of the slat assemblies closer to the cross beam 30 are positioned on a level lower than the "front" ends of the slat assemblies opposite the cross beam 30. As a result, the rain water is allowed to flow downwardly without accumulation and leaking between the slat members 52. A plurality of drain openings 74 is formed in the cross beam 30 in a spaced-apart relationship to each other. The drain openings 74 allow water to drain from the slat assemblies 40 directing rain water and snow runoff away from the structure 20. The drain openings 74 are located above the slat member 52 such that the water flowing through the troughs formed by the slat members 52 is diverted away from the pergola structure 20.

FIG. 2 illustrates a closed position of the covering system 10. In this position, the slat members 52 are oriented substantially horizontally in contrast to the open position illustrated in FIG. 1, where the slat members 52 are oriented substantially vertically. In the closed position, the upper ends 54 of the slat members 52 overlap the lower ends of the slat members 52 and completely block the sun. Of course any intermediate position of the slat members 52 will allow more or less sun to penetrate between the slat members 52.

Figure 3:
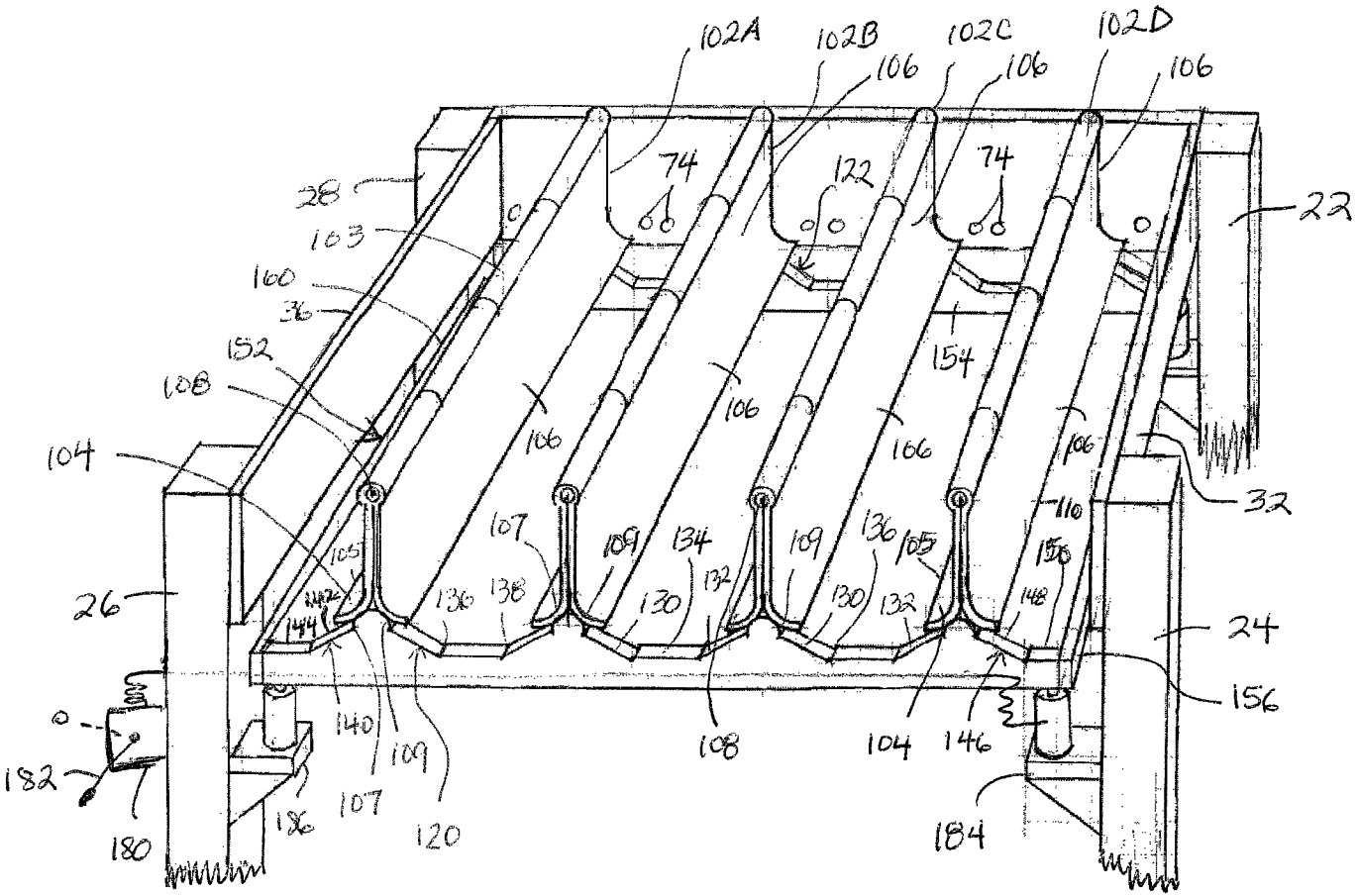
FIG. 3 a perspective view of the pergola cover system according to the second embodiment of the present invention in an open position.
Figure 4:
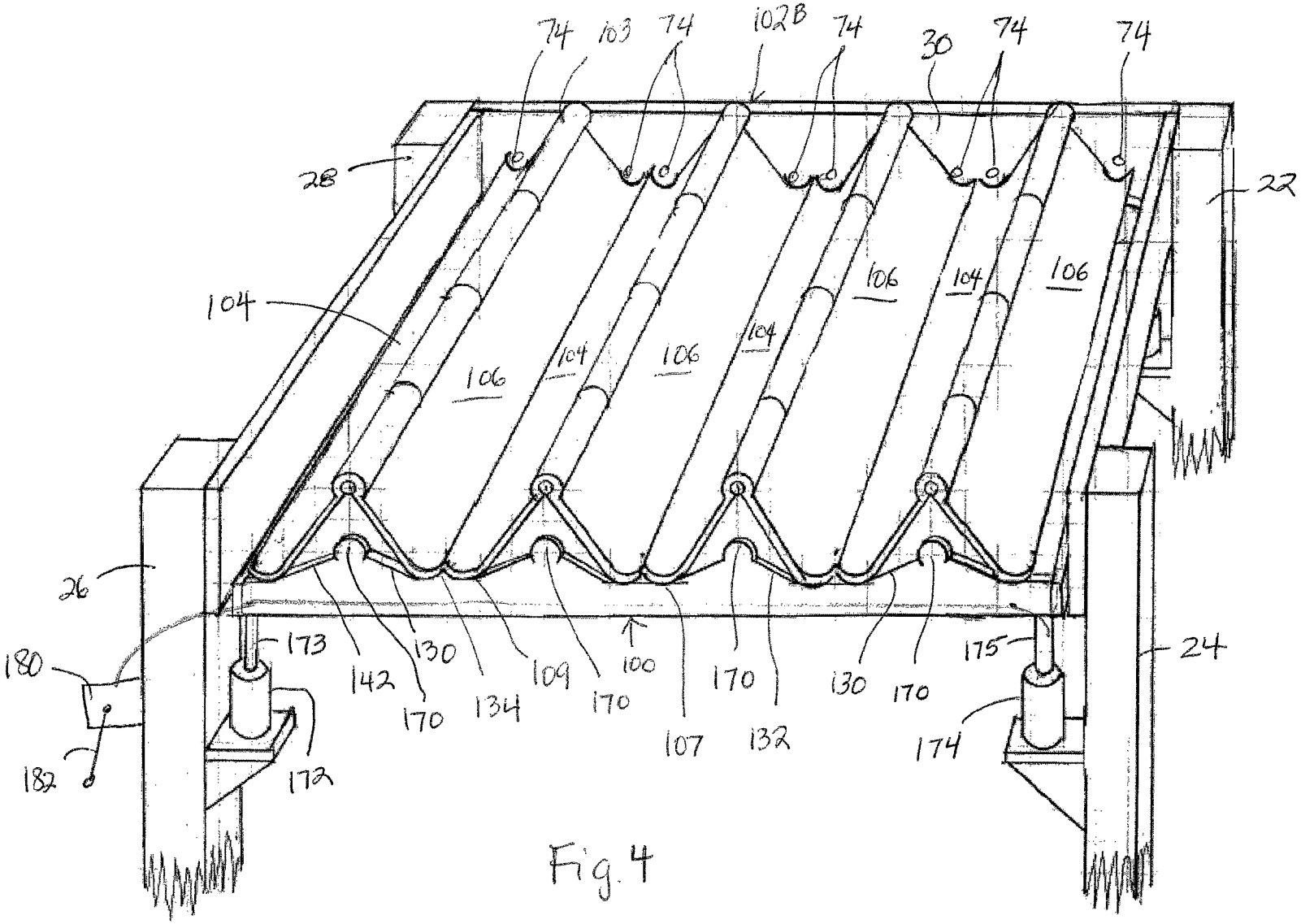
FIG. 4 a perspective view of the pergola cover system according to the second embodiment of the present invention in a closed position.

Turning now to the second embodiment of the covering system of the present invention illustrated in FIGS. 3 and 4, the covering system is designated by numeral 100. In this embodiment, the slat assemblies 102 (102A, 102B, 102C, and 102D) comprise a pair of elongated slat members 104, 106 pivotally attached to a common shaft 108 along their longitudinal upper edges. A hinge 103 supports the slat assemblies 102 in a pivotal relationship on the shaft 108. The slat assemblies 102 are mounted in a parallel relationship to each other and to longitudinal axes of the cross beams 32 and 36.

The slat members 104, 106 have a substantially J-shaped profile and are mirror images of each other. The upwardly turned lower edges 105 of the slat members 104 face toward to cross beam 36, while the upwardly turned lower edge 110 of the slat members 106 face toward the cross beam 32. Each slat member 104 has a curved bottom 107, and each slat member 106 has a curved bottom 109 with a curvature radius of the bottom 107 being substantially equal to the curvature radius of the bottom 109. When the covering system is in a closed position, the slat members extend in a substantially upright orientation over the pergola structure.

A sliding rail 120 is positioned below the slat assemblies 102 extending in a transverse relationship to longitudinal axes of the slat members 104, 106. A similar sliding rail 122 is positioned adjacent the opposite ends of the slat assemblies 102 adjacent the cross beam 30. The sliding rails 120 and 122 extend in parallel to the cross beams 30 and the cross beam opposite the cross beam, which is not shown in the drawings.

Some of the sliding rails 120 and 122 comprise a first inclined rail member 130 positioned adjacent the bottom 109 of the slat member 106, a second inclined rail member 132 positioned adjacent the bottom 105 of the slat member 104 and a third middle rail member 134 positioned between the first inclined rail member 130 and the second inclined rail member 132. The middle rail member 134 extends substantially laterally, or horizontally, and at an obtuse angle in relation to the first inclined rail member 130 and the second inclined rail member 132. Each of the rail members 130, 132, and 134 comprises a substantially planar member of narrow profile.

A first stop 136 is formed at the intersection of the first inclined rail member 130 and the middle or third rail member 134. A second stop 138 is formed at the intersection of the second inclined rail member 132 and the third rail member 134. The bottom 107 of the slat member 104 contacts the first stop 136 when the slat assemblies are in a closed position, while the bottom 109 of the slat member 106 contacts the second stop 138 when the slat assemblies 102 are in a closed position, as shown in FIG. 4.

The sliding rails adjacent the cross beams 32 and 36 are of abbreviated construction. The sliding rail 140 adjacent the cross beam 36 comprises an angular rail member 142 and a laterally extending end rail member 144. The angular rail member 142 extends at an obtuse angle to the end rail member 144. The sliding rail 146 adjacent the cross beam 32 comprises a first angular rail member 148 and a laterally extending end rail member 150, which is oriented at an obtuse angle in relation to the angular rail member 148. The mirror image sliding rail 122 has similarly arranged rail members.

The sliding rails 120 and 122 are formed on top of a rail frame 152, which is in turn fitted within the pergola structure 20 and is supported by the cross beams of the pergola structure. The rail frame 152 comprises supporting rails 154, 156, 158, and 160, which form a rectangular or square rail supporting structure. The sliding rails 120 and 122 are formed by top edges of the supporting rails 154, 158.

A curved spreader member 170 is located on top of the supporting rails 154, 156 between the angular and inclined sliding rails. The spreader member 170 is positioned to fit between the curved bottoms 107 and 109 of the slat members 104 and 106, respectively when the slat assemblies 102 are in an open position, as shown in FIG. 3. The spreader member 170 is located below the raised slat members 104 and 106 when the slat assemblies are in the open position, as shown in FIG. 4.

The pergola covering system 100 comprises a lifting means for moving the slat assemblies 102 between a normal open position to a closed position, the lifting means comprising a pair of power units 172, 174 mounted below the rail frame 152. A connection cable 176 extends between the power units 172 and 174 to facilitate synchronized movement of the sliding rails in moving the slat members 104, 106 between the open and closed positions. The power units 172, 174 can be hydraulically or electrically operated; they can also be operated by pressurized gas. A single power switch 180 with a handle 182 is used to activate opening and closing of the slat assemblies 102. The power units 172, 174 can be mounted on the vertical supports 24, 26 or on specially provided brackets 184, 1846 respectively, which are carried by the vertical supports 24, 26.

Each power unit 172, 174 has a telescopically extendable lifting member 173, 175, respectively, which urge against the underside of the rail frame 152 in lifting and lowering the rail frame. As the rail frame is lifted, the sliding rails are lifted causing the pivotal action of the slat members 104, 106. The bottom sections of the hinged slat members 104, 106 move apart causing the slat members to extend at a greater angle in relation to each other. The edges 105, 110 then come together and close the canopy above the pergola structure 20. When the handle 182 is moved to de-activate the lifting members 173, 175, the power units 172, 174 allow the lifting arms to telescopically move down into the housings of the power units.

The slat members 104, 106 are then move closer together into an almost vertical orientation, as shown in FIG. 3, while the bottoms 107, 109 of the slat members 104, 106 slide along the sliding rails 120, 122. In the closed position, the bottoms of the slat members 104, 106 contact the stops 136, 138 and rest above the middle lateral sliding rails 134 and end rails 144, 150. Of course, the power units 172, 173 can be activated and de-activated in any desired position of the slat members so that the pergola structure 20 is partially covered.

Similar to the first embodiment, the cross beam 30 is provided with drain openings 74 to allow runoff of water from the slat assemblies 102. When the slat assemblies 102 are in the closed position, the drain openings 74 are positioned above the upwardly curved portions of the slat members 104, 106.

The length of the slat assemblies can be adjusted to accommodate an existing or standard pergola structure. Similarly, the width of the slat members can be modified to fit the dimensions of standard or existing pergola structure. The covering systems 10 and 100 can also be custom made for a specific arbor structure. The slat assemblies can be formed from a variety of non-corrosive and/or weather-resistant materials.

Many changes and modifications can be made in the design of the present invention without departing from the spirit thereof I, therefore, pray that my rights to the present invention be limited only by the scope of the appended claims.

I claim:

1. A roof covering apparatus for a structure having a plurality of upright supports and at least a pair of parallel cross beams, said at least pair of parallel cross beams having longitudinal axes and lateral axes, secured to the upright supports, the apparatus comprising:

(i) a plurality of elongated parallel slat assemblies, each slat assembly comprising a pivotal shaft mounted for pivotal movement between said at least pair of parallel cross beams, wherein said pivotal shaft extends transversely to said longitudinal axes of said at least pair of parallel cross beams, and at least one slat member carried by said pivotal shaft, said slat assemblies being pivotally movable between an open position, when the at least one slat member of each of the slat assemblies extends in a covering relationship over the structure, and a closed position, when the at least one slat member is in a substantially upright orientation over the structure;

wherein the at least one slat member has a J-shaped profile;

wherein each of the slat assemblies comprises a pair of elongated slat members, each of said pair of elongated slat members having an upper edge, wherein said pair of elongated slat members are pivotally attached to a common shaft along said upper edges of said pair of elongated slat members; and wherein each slat member of the pair of slat members has a curved bottom; and (ii) a pair of sliding rails positioned directly beneath the slat assemblies and adjacent said curved bottom of the slat members, and extending in a transverse relationship to the longitudinal axes of the slat assemblies;

wherein each of the sliding rails comprises a first inclined rail member positioned adjacent the bottom of one slat member, a second inclined rail positioned adjacent the bottom of an adjacent slat member, and a middle rail member positioned between the first inclined rail member and the second inclined rail member.

2. The apparatus of claim 1, wherein the middle rail member extends substantially horizontally, and at an obtuse angle in relation to the first inclined rail member and the second inclined rail member.

3. The apparatus of claim 1, comprising a first stop formed at the intersection of the first inclined rail member and the middle rail member and a second stop formed at the intersection of the second inclined rail member and the middle rail member.

4. The apparatus of claim 3, wherein the bottom of one of the pair of slat members is configured to contact the first stop, and the bottom of another of the pair of slat members is configured to contact the second stop when the slat assemblies are in a closed position.

5. The apparatus of claim 3, comprising a curved spreader member positioned between the adjacent inclined rail members, the spreader member being configured to fit between curved bottoms of the pair of the slat members when the slat assemblies are in the open position.

6. The apparatus of claim 5, comprising a power source configured to move the sliding rail members and the spreader member and transmit pivotal force to the slat assemblies.

7. A roof covering apparatus for a structure having a plurality of upright supports and at least a pair of parallel cross beams having longitudinal axes and lateral axes secured to the upright supports, the apparatus comprising:

(i) a plurality of elongated parallel slat assemblies, each slat assembly comprising a pivotal shaft mounted for pivotal movement between said at least pair of parallel cross beams, wherein said pivotal shaft extends transversely to said longitudinal axes of said at least pair of parallel cross beams, and a pair of elongated slat members pivotally attached to a common shaft along their upper edges, each of the slat members having a J-shaped profile, said slat assemblies being pivotally movable between an open position, when the at least one slat member is in a substantially upright orientation, and a closed position, wherein the at least one slat member of each of the slat assemblies extends in a covering relationship over the structure;

wherein each slat member of the pair of slat members has a curved bottom; and (ii) a pair of sliding rails positioned directly beneath the slat assemblies and adjacent said curved bottom of the slat assemblies, and extending in a transverse relationship to longitudinal axes of the slat assemblies;

wherein each of the sliding rails comprises a first inclined rail member positioned adjacent the bottom of one slat member, a second inclined rail member positioned adjacent the bottom of an adjacent slat member, and a middle rail member positioned between the first inclined rail member and the second inclined rail member.

8. The apparatus of claim 7, wherein the middle rail member extends substantially horizontally, and at an obtuse angle in relation to the first inclined rail member and the second inclined rail member.

9. The apparatus of claim 7, comprising a first stop formed at the intersection of the first inclined rail member and the middle rail member and a second stop formed at the intersection of the second inclined rail member and the middle rail member.

10. The apparatus of claim 9, wherein the bottom of one of the pair of slat members is configured to contact the first stop, and the bottom of another of the pair of slat members is configured to contact the second stop when the slat assemblies are in a closed position.

11. The apparatus of claim 7, comprising a curved spreader member positioned between the adjacent inclined rail members, the spreader member being configured to fit between curved bottoms of the pair of the slat members when the slat assemblies are in the open position.

12. The apparatus of claim 7, comprising a power source configured to move the sliding rail members and the spreader member and transmit pivotal force to the slat assemblies.

* * * * *